US005655343A

United States Patent [19]

Seals

[11] Patent Number: 5,655,343

[45] Date of Patent: Aug. 12, 1997

[54] APPARATUS AND METHOD FOR AN ADJUSTABLE SHIM FOR DOORS AND WINDOWS

[75] Inventor: Frederick L. Seals, Yakima, Wash.

[73] Assignee: Fred Seals Construction, Inc., Yakima, Wash.

[21] Appl. No.: 677,507

[22] Filed: Jul. 9, 1996

[51] Int. Cl.[6] ..... E06B 1/04

[52] U.S. Cl. ..... 52/217; 52/745.15; 52/126.1; 49/505

[58] Field of Search ..... 52/217, 745.15, 52/126.1, 126.7, 127.1; 49/505

[56] References Cited

U.S. PATENT DOCUMENTS

| | | | |
|---|---|---|---|
| 2,700,441 | 1/1955 | Cudini | 52/217 X |
| 3,250,049 | 5/1966 | Sklar . | |
| 3,571,996 | 3/1971 | Braswell | 49/505 X |
| 3,585,770 | 6/1971 | Maizier | 52/217 |
| 3,889,423 | 6/1975 | Begin | 52/213 X |
| 4,637,183 | 1/1987 | Metz | 52/217 |
| 4,887,407 | 12/1989 | Nelson | 52/745.15 |
| 5,038,538 | 8/1991 | Rozon | 52/217 X |
| 5,233,802 | 8/1993 | Rogers | 52/217 X |

*Primary Examiner*—Robert Canfield
*Attorney, Agent, or Firm*—Stratton Ballew

[57] ABSTRACT

An extendible and tiltable shim is provided having a hingeably connected leg that is extendable. The leg can extend to adjust the height and the angle of the shim. The shim is mounted to a structure member and abuts to a frame member. The structure member can comprise a rough opening in a wall. The frame member can comprise a door jamb or a window jamb. The method of the invention includes an initial step of attaching the bottom plate of the shim to a structure, extending the leg to contact the frame member, and adjusting the extension of the leg to center and plumb the frame member. The shim accurately and reliably adjusts a door jamb or window jamb within a rough opening in a wall for proper alignment. The shim tilts at an angle and offsets to accommodate crooked and misaligned wall structure. The shim can easily retrofit to a standard door jamb or a window frame for the purpose of aiding in the square alignment of the door jamb or window jamb within a rough opening in wall structure.

15 Claims, 10 Drawing Sheets

APPARATUS AND METHOD FOR AN ADJUSTABLE SHIM FOR DOORS AND WINDOWS

TECHNICAL FIELD

The invention relates to a shimming apparatus and method of installing a shimming apparatus for doors and windows, and more particularly to a method and apparatus for an extendable and tiltable shim for use in installing door and window jambs.

BACKGROUND OF THE INVENTION

The task of installing a door jamb or window jamb within a wall opening is often difficult. The door jamb or frame must be installed in a near perfect alignment to enable the door hung within it to open, close and swing smoothly. Additionally, a window or door that is even a fraction out of plumb is readily apparent to an observer. Once the casings and moldings have been applied to a window jamb or door jamb, it is difficult and expensive to correct mistakes made during the installation.

Skilled carpenters installing doors and windows continue to employ traditional techniques used for decades. These techniques include centering the window jamb or. door jamb, involving a complicated series of measurements and adjustments using tools such as bubble levels, plumb bobs, framing squares and tape measures. To properly align the window or door, wedge shaped shims are conventionally tapped between the door jamb or window jamb and the wall's structural members to force the door or window jamb into a desired position. Conventional shims, typically made of wood wedges or shingles, are inconsistent in size and shape and thus add to the difficulty of properly installing a door or window jamb. More particularly, these wedge shaped shims are imprecise and without a size standard. Therefore, a shim is needed that accurately and reliably adjusts a door jamb or window jamb within a rough opening in a wall for proper alignment.

Several prior U.S. Patents show devices to aid in the installation of metal door and window frames or jambs. These devices typically damp onto the wall structure adjacent to the installed door or window for the sole purpose of anchoring a metal door jamb to the wall structure. Metal door jambs are not found in residential construction. Residential door and window jambs or frames are often fabricated from wood products. Alternative residential type jamb or frame materials include vinyl, aluminum and wood composite. Residential door and window jambs are typically lighter in construction than the heavy metal door jambs employed in fire rated metal door jamb and window jamb installations. The patented metal door jamb installation aids all fail to provide a device that can be added to a residential door or window jamb to accommodate walls that are crooked or misaligned openings in the wall.

These patents for devices to aid in the installation of metal door jambs are typically similar to the U.S. Pat. No. 3,250,049 to Sklar for an adjustable damping door jamb. The Sklar patent shows a threaded screw actuated movement only for clamping the adjacent wall member. Typically, when doors and windows are installed, a initial crude opening is made in the wall to accommodate the door or window. These "roughed out" openings are often crooked and misaligned. Sklar falls to solve the problem of aligning a door jamb within a wall structure that is crooked or misaligned.

U.S. Pat. No. 3,889,423 to Begin discloses screw operated "shim members" that are integral within a metal door frame.

Begin teaches the use of the shims to pull the posts of the door frame outward toward the structure of the adjacent wall. The Begin patented door frame shim member is not able to adjust to a misaligned wall structure and therefore does not fulfil a need for a shim that accommodates a crooked or misaligned wall structure.

U.S. Pat. No. 4,637,183 to Metz shows a two-part shim incorporated within a door or window frame. The shim has one bolt connecting the two parts at an angle. The shim also includes an integral wing for a hinge. The shim legs damp the shim to the wall structure. The Metz shim is unable to adjust the door or window to accommodate a crooked or misaligned wall structure.

U.S. Pat. No. 4,887,407 to Nelson describes an alignment dip for use in a window frame. A screw means is claimed for biasing the base of the alignment clip. Four screws are preferred, to compress a leaf spring positioned between a plate and a bottom wall of the base. The spring adjusts the window frame for a tight and secure fit into an opening. Nelson teaches using the alignment dip for squaring the window and holding it in a plumb position. The Nelson alignment dip is integral within a metal extruded sash of the window. A further need exists for a shim that can retrofit to any window jamb or frame of a standard design.

Another drawback to the Nelson alignment clip is that it also has a very limited range of "biasing" to accommodate a wall opening that is misaligned or crooked. Wall structure is often found to be out of alignment to an extent that the design of the Nelson alignment clip is unable to compensate. Again, the known devices fail to satisfy a need for a shim that can tilt at a significant angle, instead of only a limited bias, to accommodate the wall opening.

Furthermore, the Nelson alignment clip requires an "adjustable tab means" to allow the alignment dip to accommodate wall openings outside the limited range of the "rotation of the screws." This "adjustable tab means" is cumbersome and fails to accommodate windows with which it was not specifically designed for use. Therefore, further a need exists for a shim without an "adjustable tab means" to accommodate a rough wall opening. Additionally, a need exists for a shim that is expandable to significantly adjust to the rough opening in a wall.

Due to the inadequacies of conventional devices, there remains a need for a tiltable and extendable shim that can easily retrofit to a standard door jamb or a window frame, for aiding the square alignment of the door or window jamb within a roughed out opening in a wall structure.

SUMMARY OF INVENTION

According to the invention, an extendable and tiltable shim is provided having a hingeably connected leg. The leg is extendable to adjust the height and the angle of the shim. The shim also includes a bottom plate. The bottom plate of the shim mounts to a structure member. The structure member can be an interior or exterior wall. The shim also attaches to or engages a frame member. The frame member can be a door or window jamb.

The method of the invention includes attaching the bottom plate of the shim to a structure, extending the leg relative to a movable jamb, and adjusting the extension of the leg to center and plumb the jamb.

According to one aspect of the invention, the shim accurately and reliably adjusts a door or window jamb within a rough opening in a wall for proper alignment.

According to another aspect of the invention, the shim tilts by expanding or compressing each end of the shim to accommodate crooked and misaligned wall structure.

According to still another aspect of the invention, the shim is expandable to significantly adjust to the rough opening in a wall.

According to yet another aspect of the invention, the shim can easily retrofit to a standard door or a window jamb for aiding in the square alignment of the door or window jamb within a rough opening in a wall structure.

DETAILED DESCRIPTION OF SPECIFIC EMBODIMENTS

Figure 1:
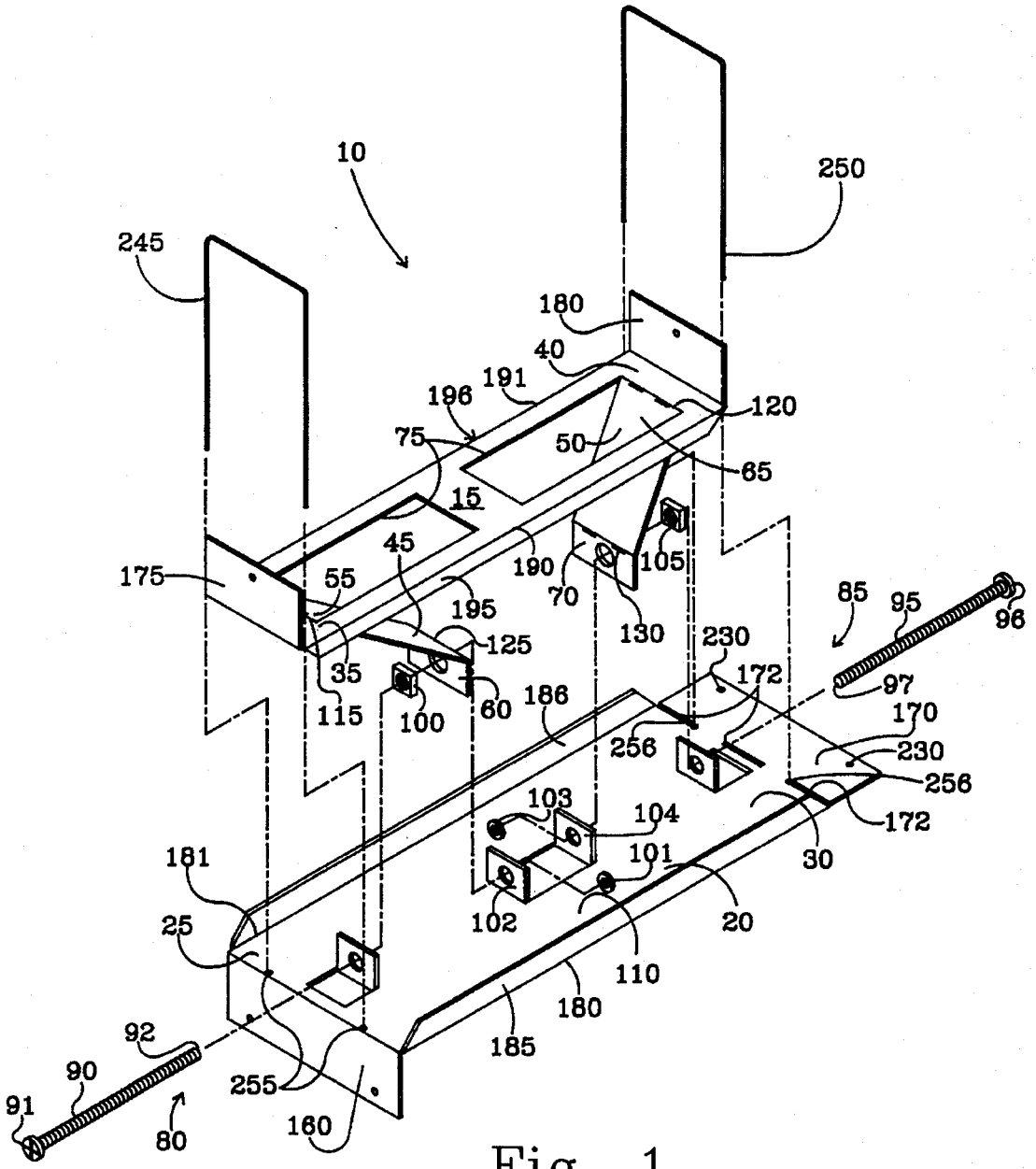
FIG. 1 is an exploded perspective diagram of a shim, according to an embodiment of this invention.

The invention provides a method and apparatus for an extendable and tiltable shim for use in installing a door or a window jamb. As shown in an embodiment illustrated in FIGS. 1 and 2, hereinafter referred to as embodiment A, the shim 10 includes a top plate 15 and a bottom plate 20. The bottom plate is preferably rectangular in shape and has a first bottom end 25 and a second bottom end 30. The top plate is also preferably rectangular and has a first top end 35 and a second top end 40.

The top plate 15 also has a first leg 45 and a second leg 50. The first leg has a first base 55 and a first tip 60. The second leg also has a second base 65 and a second tip 70. The first leg and the second leg are each hingeably connected at their respective bases to the top plate. The top plate, first leg and second leg are preferably formed from a single piece of stamped metal. The first leg and the second leg are each preferably formed by a U-shaped cut 75 into the single piece of stamped metal that comprises the top plate.

The first leg 45 and the second leg 50 are downwardly extendable from the top plate 15. The first leg and the second leg oppose each other, hinging from the top plate at the first top end 35 and the second top end 40, respectively. The first leg attaches to a first screw drive 80 and the second leg attaches to a second screw drive 85. The first screw drive and the second screw drive are preferably mounted upon the bottom plate 20. The first screw drive penetrates through the first tip 60 of the first leg and the second screw drive penetrates through the second tip 70 of the second leg.

Alternatively, the first leg 45 and the second leg 50 can include a crease (not shown) along their lengths from the first base 55 and second base 65 to the first tip 60 and the second tip 70, respectively. The crease adds to the structural rigidity of the first leg and second leg. Other alternative strengthening means for the legs of the shim 10 are also considered, such as a metal strip attached on the length of each leg, between the base and the tip.

The first screw drive 80 includes a first adjustment screw 90 and the second screw drive includes a second adjustment screw 95. The first adjustment screw has a first head 91 and a first screw end 92, and the second adjustment screw has a second head 96 and a second screw end 97. Preferably, the first head and the second head each can receive a screw driver or similar device for rotating the first head or the second head, respectively.

Also preferably, a first nut 100 threads upon the first adjustment screw 90. The first nut is attached to the first tip 60 of the first leg 45. Similarly, a second nut 105 is threaded upon the second adjustment screw 95. The second nut attaches to the second tip 70 of the second leg 50. Alternatively, a pair of steel speed nuts (not shown), which are small clips, or a similar means, could be employed in the screw drives, rather than nuts. The speed nut should snap onto the respective first tip and second tip of the legs and include a penetration to receive the threads of the adjustment screws. Also, the first nut and second nut are preferably spot welded to the respective first tip and second tip, although alternative methods of attachment are considered, such as crimping or gluing.

The first screw end 92 and the second screw end 97 are prevented from being accidentally removed from the shim 10 by tabs 102, 104, and threaded retainers 101, 103, respectively. The first screw end and the second screw end are inserted through holes in the tabs and held in place by the retainers as shown in FIG. 1. Alternatively, the first screw end and the second screw end are inserted through the holes in the tabs, and then pounded or flattened to broaden the diameter of the screw so that it will not pass back through the hole. Such an embodiment would not specifically require the use of a retainers.

As preferred, when the first adjustment screw 90 is rotated clockwise, the first screw drive 80 forces the first tip 60 to travel along the first adjustment screw toward the first bottom end 25 of the bottom plate 20, extending the first leg 45 and raising the first top end 35 of the top plate 15. When the first adjustment screw is rotated counterclockwise, the first screw drive forces the first tip to travel along the first adjustment screw away from the first bottom end. As a result of this rotation the first leg retracts toward the top plate, while lowering the first top end.

Similarly, when the second adjustment screw 95 is rotated clockwise, the second screw drive 85 forces the second tip 70 to travel along the second adjustment screw toward the second bottom end 30 of the bottom plate 20, extending the second leg 50 and raising the second top end 40 of the top plate 15. When the second adjustment screw is rotated counterclockwise, the second screw drive forces the second tip to travel along the second adjustment screw away from the second bottom end, retracting the second leg toward the top plate and lowering the second top end.

Figure 2:
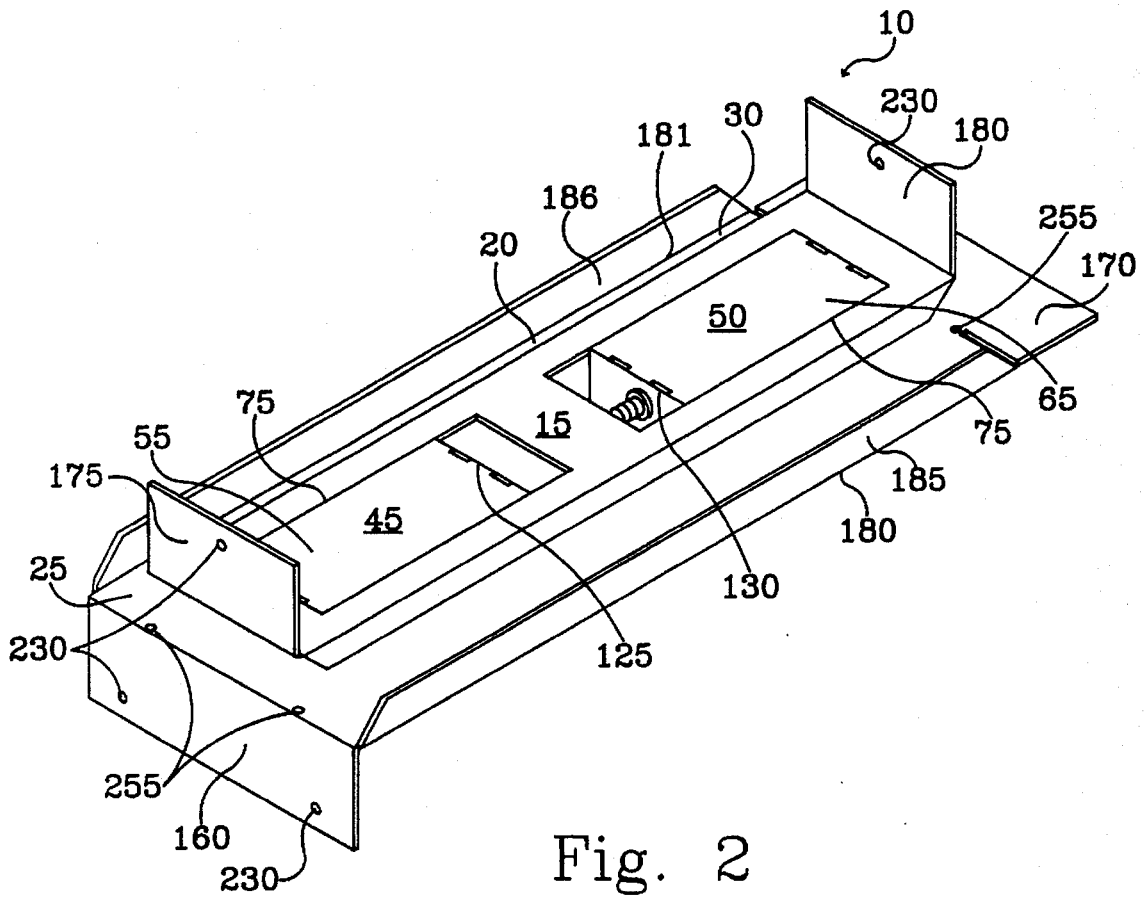
FIG. 2 is a perspective diagram of a shim, according to an embodiment of this invention.

As shown in FIGS. 1 and 2, a pair of screw drives is preferably employed in each shim 10. The first screw drive 80 and the second screw drive 85 respectively force the first tip 60 and the second tip 70 of the first leg and the second leg to travel parallel to the bottom plate 20. Initially, the shim is in the collapsed position, with the first tip 60 and the second tip 70 of the respective first leg 45 and second leg 50 located at or near a midpoint 110 of the bottom plate. From the collapsed position the first screw drive and the second screw drive can each be rotated clockwise to force the first tip and second tip of the first leg and second leg respectively away from the midpoint of the bottom plate.

A first top hinge 115 connects the first base 55 of the first leg 45 to the top plate 15. A second top hinge 120 connects the second base of the second leg 50 to the top plate. The movement of the first leg and the second leg away from the midpoint 110 of the bottom plate 20 forces the first top hinge and the second top hinge to bend, increasing the distance between the top plate 15 and the bottom plate.

A first base hinge 125 connects the first leg 45 to the first tip 60. A second base hinge 130 connects the second leg 50 to the second tip 70. In cooperation with the first top hinge 115 and the second top hinge 120, the first base hinge and the second base hinge respectively bend as the first tip and the second tip respectively travel along the first adjustment screw 90 and the second adjustment screw 95. The hinging actions of the first base hinge and the second base hinge respectively maintain the first tip and the second tip perpendicular to the first adjustment screw and the second adjustment screw.

When both the first screw drive 80 and second screw drive 85 are rotated together in the clockwise direction to respectively extend the first leg 45 and the second leg 50, the top plate 15 extends substantially parallel to the bottom plate 20. When only the first screw drive or the second screw drive is rotated, the top plate is extended at an angle relative to the bottom plate.

Figure 9:
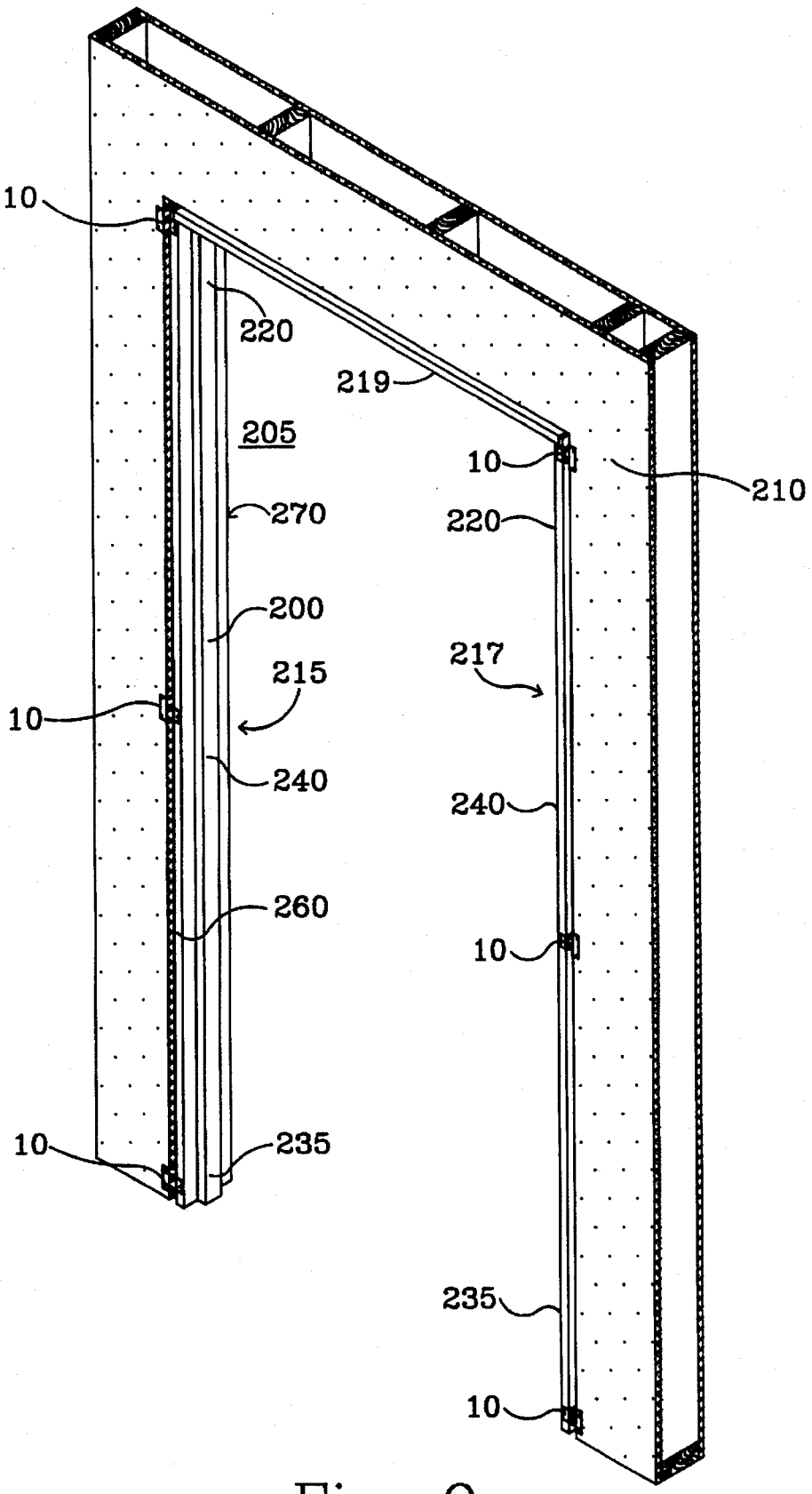
FIG. 9 is a perspective diagram of a shim installation, according to an embodiment of this invention.

As shown in FIG. 9, the angled extension of the top plate 15 is useful when a rough opening 205 in a wall 210 or similar structure for receiving a door (not shown) housed within a door jamb 200 or similar frame is not exactly centered and plumb with respect to the desired final location of the door. An installer of the door jamb can incrementally and individually extend the first screw drives 80 and the second screw drives 85 of the shims 10, of FIG. 1, that are positioned on a hinge side 215 of the door jamb 200, as shown in FIG. 9. Correspondingly, by incrementally retracting each of the first screw drives and the second screw drives of the shims positioned on the latch side 217 of the door jamb, the entire door jamb is incrementally moved toward the latch side of the door jamb.

Other adjustments of the shim 10 provide incremental realignments of the door jamb 200 in a manner that positions the door jamb in a desired final position that is plumb and centered. For example, the shim can be offset to compensate for a misaligned wall 210 or wall structure by incrementally adjusting the first screw drive 80 and the second screw drive 85 while the shim is in the compressed or retracted position as depicted in FIG. 2. From the retracted position, the top plate 15 of the shim can be offset while remaining substantially parallel to the bottom plate 20 of the shim.

Preferably, the first bottom end 25 of the bottom plate 20 has a first bottom flange 160 hingeably affixed to it. Similarly, the second bottom end 30 of the bottom plate preferably has a second bottom flange 170 hingeably affixed to it. Preferably, the first bottom flange is bent downward to a ninety degree (90°) angle relative to the bottom plate by the manufacturer of the shim, as shown in FIGS. 1 and 2. The second bottom flange is preferably bent down similarly to the first bottom flange by the installer, after the shim is inserted into the rough opening. The hinging of the second bottom flange can be aided by including small cuts 172 in the stamped sheet metal of the bottom plate at the second bottom end to allow the second flange to easily bend. Alternatively, instead of small cuts in the bottom plate for the second bottom flange, perforations (not shown) are also conceived by the inventor.

Also preferably, the first top end 35 of the top plate 15 has a first top flange 175 hingeably affixed to it. The first top flange can be aided by including small cuts (not shown) or perforations (not shown) in the stamped sheet metal of the top plate at the first top end to allow the first top flange to easily bend. Similarly, the second top end has a second top flange 180 hingeably affixed to it. The second top flange can also be aided by including small cuts in the stamped sheet metal at the second top end to allow the second top flange to easily bend. Preferably, the first top flange and the second top flange are narrow enough to bend without the addition of small cuts or perforations as preferably included with the second bottom flange.

Preferably, the bottom plate 20 also includes a pair of bottom edges 180 and 181. Each of the bottom edges preferably includes bottom side tabs 185 and 186 that are respectively bent upward toward the top plate 15. The bottom side tabs increase the structural rigidity of the bottom plate. Similarly, the top plate also has a pair of top edges 190 and 191. Each of the side edges preferably includes a top side flange 195, 196 that are respectively bent downward toward the bottom plate. The top side flanges increase the structural rigidity of the top plate. The top side flanges also act as stops to prevent the top plate from totally collapsing onto the bottom plate.

Preferably, the top plate 15 and the bottom plate 20 are fabricated of a metal alloy, and most preferably stamped out of light gage sheet metal. 22 gage sheet metal of conventional manufacture having a thickness of approximately 0.048 inches performs adequately. Conventionally manufactured sheet metal is a low carbon steel, typically having a mean carbon content less than 0.15%. Alternatively, other metals and metal alloys, plastics, wood and composite materials are considered by the inventor for use in fabricating the shim 10. A premium shim fabricated of stainless steel could be specified to assure that the shim remains rust free. Also alternatively, a non-metal shim may be required in other installations, to lower the weight of the shim, its electrical or heat conductivity, or potentially lower its cost of manufacture. Additionally, when fabricated of stamped sheet metal, the top plate and the bottom plate can be dipped in a zinc galvanizing coating or preferably sprayed with a rust resistant paint formulation.

Figure 3:
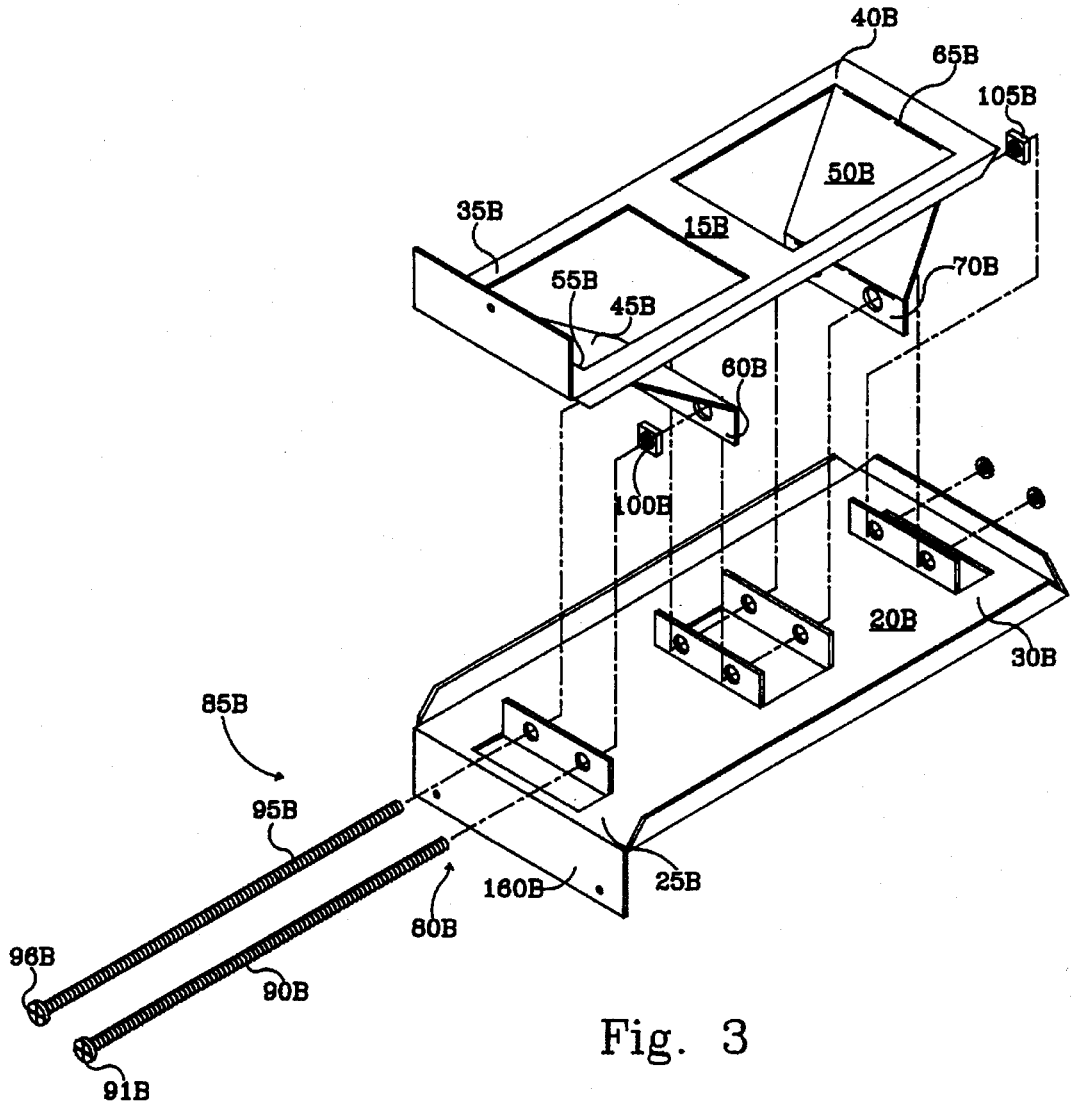
FIG. 3 is an exploded perspective diagram of a shim, according to an embodiment of this invention.
Figure 4:
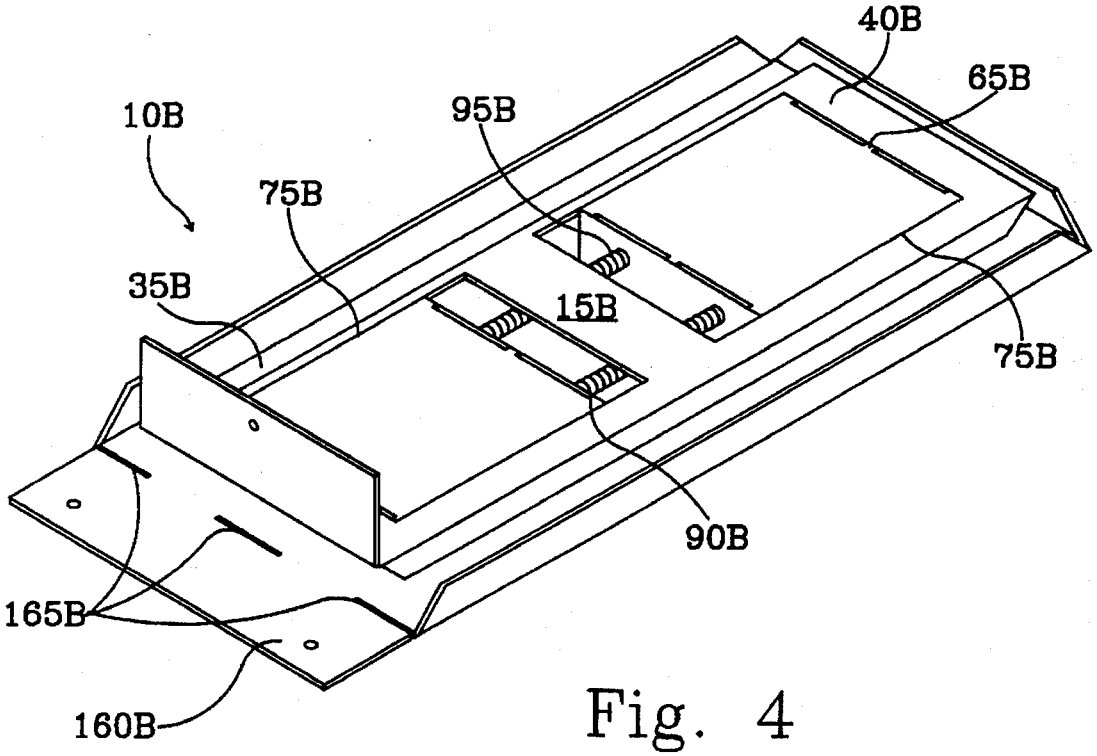
FIG. 4 is a perspective diagram of a shim, according to an embodiment of this invention.

An alternative embodiment of the present invention is shown in FIGS. 3 and 4, hereinafter referred to as embodiment B. The reference characters for embodiment B all end in the letter "B". The shim 10B of embodiment B includes a top plate 15B and a bottom plate 20B. The bottom plate is preferably rectangular in shape and has a first bottom end 25B and a second bottom end 30B. The top plate is also preferably rectangular and also has a first top end 35B and a second top end 40B.

The top plate 15B of the shim 10B also has a first leg 45B and a second leg 50B. The first leg has a first base 55B and a first tip 60B. The second leg also has a second base 65B and a second tip 70B. The first leg and the second leg are each hingeably connected at their respective first base and second base to the top plate. The first leg, the second leg and the top plate are preferably fabricated from a single piece of stamped metal. The first leg and the second leg are each preferably formed by a U-shaped cut 75B into the single piece of stamped metal that comprises the top plate.

The first leg 45B and the second leg 50B are downwardly extendable from the top plate 15B. The first leg and the second leg oppose each other, hinging from the top plate at the first top end 35B and the second top end 40B, respectively. The first leg attaches to a first screw drive 80B and similarly, the second leg attaches to a second screw drive 85B. The first screw drive and the second screw drive are preferably mounted upon the bottom plate 20B.

Embodiment B is similar to the embodiment A that is shown in FIGS. 1 and 2. Significantly, embodiment B differs from the embodiment A in that the first screw drive 80B and the second screw drive 85B are both adjustable from the first bottom end 25B of the shim 10B. The first screw drive 80B penetrates through the first tip 60B of the first leg 45B and the second tip 70B of the second leg 50B. The second screw drive also penetrates through the first tip of the first leg and the second tip of the second leg.

Preferably, the first screw drive 80B includes a first adjustment screw 90B and the second screw drive 85B includes a second adjustment screw 95B. A first nut 100B threads upon the first adjustment screw. The first nut attaches to the first tip 60B of the first leg 45B. Similarly, a second nut 105B threads upon the second adjustment screw. The second nut attaches to the second tip 70B of the second leg 50B. The first nut and second nut are preferably spot welded to the respective first tip and second tip, although alternative methods of attachment are considered, such as crimping or gluing.

The first adjustment screw 90B has a first head 91B and the second adjustment screw 95B has a second head 96B. Preferably, the first head and the second head each can receive a screwdriver (not shown) or similar device for rotating the first head or the second head. As preferred, when the first adjustment screw 90B is rotated clockwise, the first screw drive 80B forces the first tip 60B to travel along the first adjustment screw toward the first bottom end 25B of the bottom plate 20B, extending the first leg 45B and raising the first top end 35B of the top plate 15B. When the first adjustment screw is rotated counterclockwise, the first screw drive forces the first tip to travel along the first adjustment screw away from the first bottom end of the bottom plate, retracting the first top end of the top plate, and lowering the first top end of the top plate.

Similarly, when the second adjustment screw 95B is rotated counterclockwise, the second screw drive 85B forces the second tip 70B to travel along the second adjustment screw 95B toward the second bottom end 30B of the bottom plate 20B, extending the second leg 50B and raising the second bottom end of the top plate. When the second adjustment screw is rotated clockwise, the second screw drive forces the second tip to travel along the second adjustment screw away from the second bottom end of the bottom plate, retracting the second top end of the top plate and lowering the second top end of the top plate.

As preferred in embodiment B and shown in FIGS. 3 and 4, the first screw drive 80B and the second screw drive 85B are employed in each shim 10B. The first screw drive and the second screw drive are oriented so that the first head 91B of the first adjustment screw 90B is located proximate the first bottom end 25B of the bottom plate 20B. The second head 96B of the second adjustment screw 95B is also located proximate to the first bottom end of the bottom plate.

The orientation of the first adjustment screw 90B and the second adjustment screw 95B allows the shim 10B to be adjusted from one side of the shim. This feature is desirable in applications where the installation of a door or window make access to both sides of the door or window jamb difficult. Such a difficulty is typically encountered in door or window jamb installation where siding or molding, attached to a face of the jamb, covers an end of the shim and prevents an installer from accessing adjustment screws that could be located proximate to the covered end of the shim.

FIG. 3 shows embodiment B of the shim 10B with the first bottom flange 160B bent in a similar manner to the first bottom flange 160 of embodiment A. Alternatively, FIG. 4 shows the embodiment B first bottom flange as unbent. The unbent first bottom flange allows the shim to be positioned from the second end 40B of the shim and then bent to a ninety degree (90°) angle by the installer. To aid in bending the first bottom flange, slots 165B are preferably provided in the bottom plate 20B as shown in FIG. 4.

Figure 5:
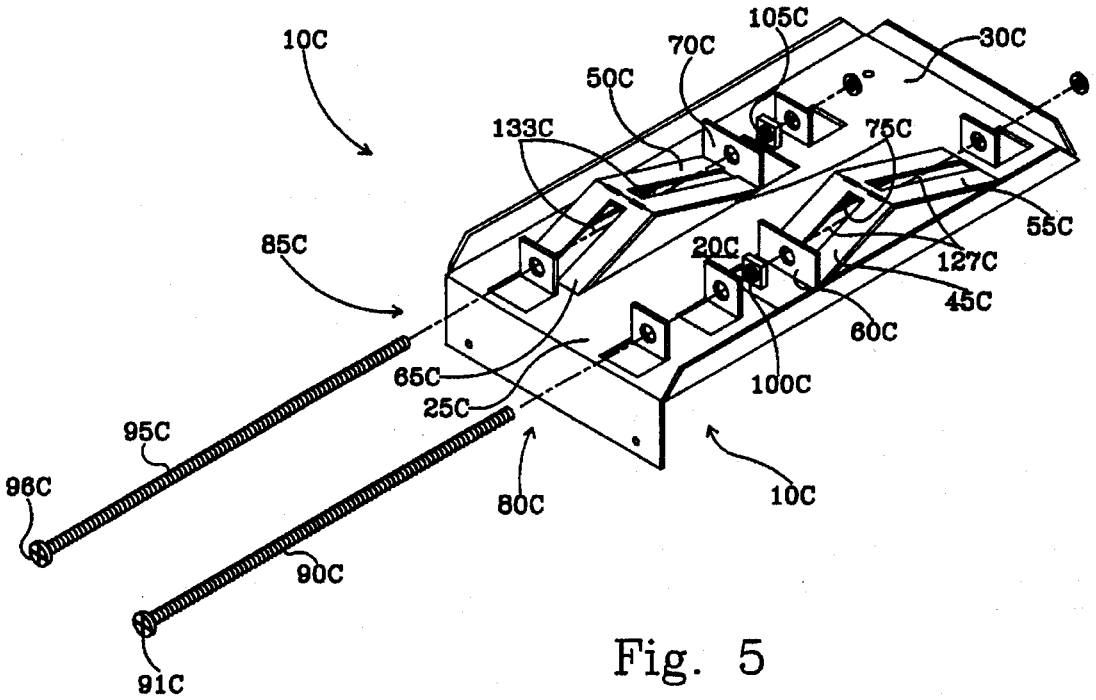
FIG. 5 is an exploded perspective diagram of a shim, according to an embodiment of this invention.
Figure 6:
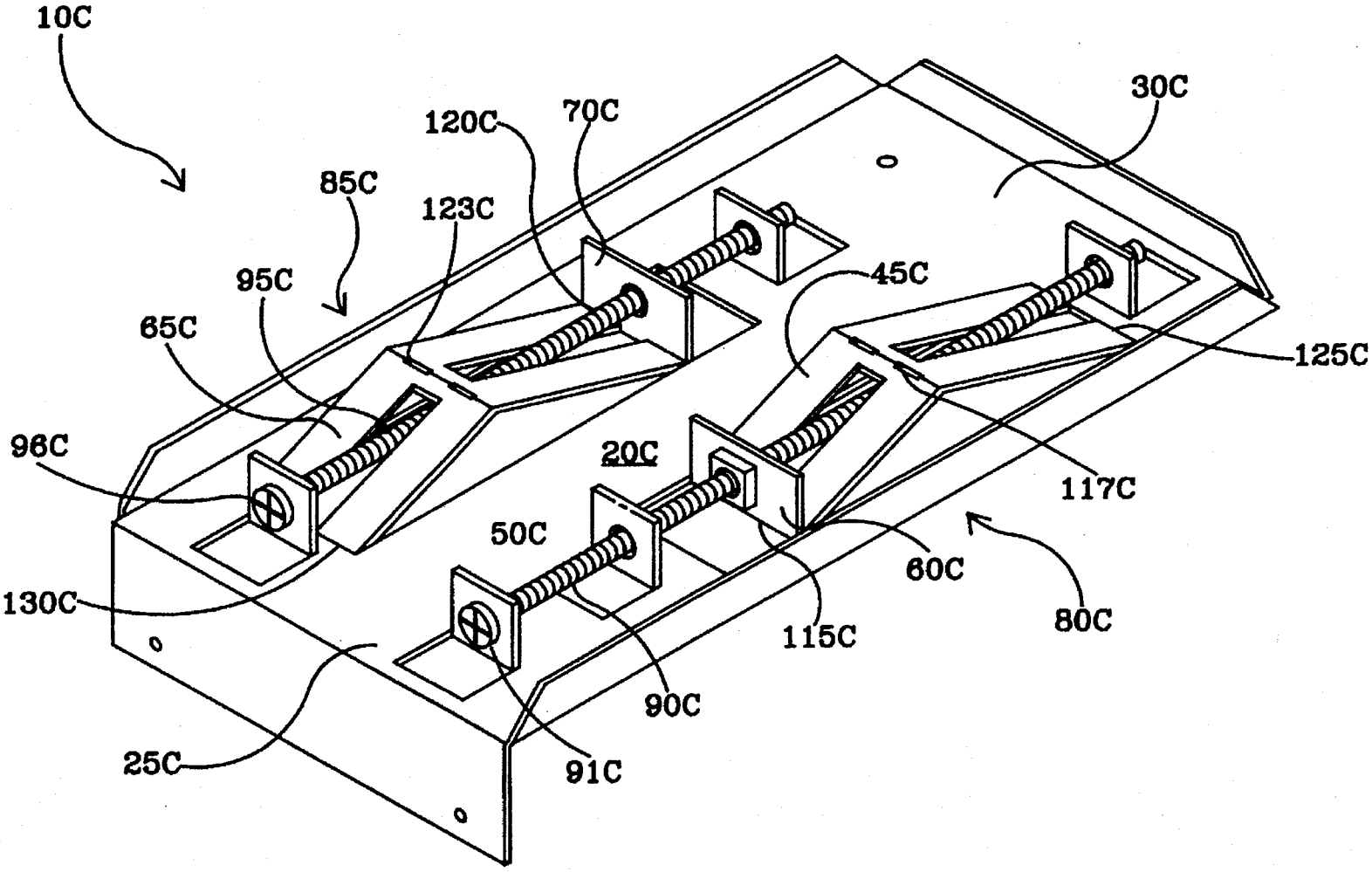
FIG. 6 is a perspective diagram of a shim, according to an embodiment of this invention.

Another alternative embodiment of the present invention is shown in FIGS. 5 and 6. The reference characters for this embodiment end in the letter "C", and the embodiment will be referred as embodiment C. Embodiment C includes a first screw drive 80C and a second screw drive 85C, attached to a bottom plate 20C. The first screw drive includes a first adjustment screw 90C and the second screw drive includes a second adjustment screw 95C. The bottom plate is preferably rectangular in shape and has a first bottom end 25C and a second bottom end 30C.

Preferably, a first leg 45C and a second leg 50C are also included in the bottom plate 20C and hingeably attach to it. The first leg has a first base 55C and a first tip 60C. The second leg also has a second base 65C and a second tip 70C. The first leg and the second leg are each hingeably connected at their respective first base and second base to the bottom plate. The first leg has a first tip hinge 115C, a first midpoint hinge 117C and a first base hinge 125C. The first base hinge connects the first base of the first leg to the bottom plate. Similarly, the second leg has a second tip hinge 120C, a second midpoint hinge 123C and a second base hinge 130C. The second base hinge connects the base of the second leg to the bottom plate.

The first leg 45C and the second leg 50C are preferably included in a single piece of stamped metal that comprises the bottom plate 20C. The first leg and the second leg are each preferably formed by a U-shaped cut 75C into the single piece of stamped metal that comprises the bottom plate. The first leg and the second leg are compressible along the first adjustment screw 90C and the second adjustment screw 95C, respectively. The first leg and the second leg preferably oppose each other, hinging from the bottom plate at the second bottom end 30C and the first bottom end 25C, respectively. The first leg attaches to a first screw drive 80C and the second leg attaches to a second screw drive 85C. The first screw drive and the second screw drive are preferably mounted upon the bottom plate 20C.

A first nut 100C threads upon the first adjustment screw 90C. The first nut attaches to the first tip 60C of the first leg 45C. Similarly, a second nut 105C threads upon the second adjustment screw 95C. The second nut attaches to the second tip 70C of the second leg 50C. The first nut and the second nut are preferably spot welded to the respective first tip and second tip. The first adjustment screw has a first head 91C and the second adjustment screw has a second head 96C. Preferably, the first head and the second head each can receive a screwdriver (not shown) or similar device for rotating the first head or the second head to respectively actuate the first screw drive 80C or the second screw drive 85C.

As preferred, when the first adjustment screw 90C is rotated counterclockwise, the first screw drive 80C forces the first tip 60C to travel along the first adjustment screw toward the second bottom end 30C of the bottom plate 10C, compressing the first leg 45C and raising the first midpoint hinge 117C. When the first adjustment screw is rotated clockwise, the first screw drive forces the first tip to travel along the first adjustment screw away from the second bottom end of the bottom plate, expanding the first leg and lowering the first midpoint hinge of the first leg.

Similarly, when the second adjustment screw 95C is rotated clockwise, the second screw drive 85C forces the second tip 70C to travel along the second adjustment screw 95C toward the first bottom end 15C of the bottom plate 10C, compressing the second leg 50C and raising the second midpoint hinge 123C of the second leg. When the second adjustment screw is rotated counterclockwise, the second screw drive forces the second tip to travel along the second adjustment screw away from the first end of the bottom plate, expanding the second leg and lowering the second midpoint hinge of the second leg.

As preferred in embodiment C and shown in FIGS. 5 and 6, the first screw drive 80C and the second screw drive 85C are employed in each shim 10C. The first screw drive and the second screw drive are oriented so that the first head 91C of the first adjustment screw 90C is located proximate to the first bottom end 25C of the bottom plate 20C and the second head 96C of the second adjustment screw 95C is also located proximate the first bottom end of the bottom plate.

This orientation of the first adjustment screw 90C and the second adjustment screw 95C allows adjustment of the shim 10C from the first bottom end 25C of the shim. This feature is desirable in applications where the installation of a door or window jamb make access to both sides of the door jamb or window frame difficult. Such a difficulty is typically encountered in installations where the siding or the building covers the second bottom end 30C of the shim, preventing access to adjustment screws that could be located proximate to the covered second end of the shim.

Embodiment C is similar to Embodiment B in that the shim 10C is adjustable from the first bottom end 25C of the shim. However, embodiment C does not include a top plate as included in embodiments A and B. The raising or lowering of the first midpoint hinge 117C or the second midpoint hinge 123C correspondingly raises or lowers a window frame or jamb (not shown) mounted upon the shim. As with embodiment B, embodiment C significantly differs from the embodiment A in that the first screw drive 80C and the second screw drive 85C are both adjustable from the first bottom end 25C of the shim. Alternatively, the first screw drive and the second screw drive of embodiment C could be oriented similarly to embodiment A, each adjustable from an opposite end of the bottom plate 20C.

In embodiment C, as shown in FIGS. 5 and 6, the first adjustment screw 90C of the first screw drive 80C penetrates through the first tip 60C of the first leg 45C. The first adjustment screw also passes through the first leg. Preferably, a pair of first leg slots 127C is included in the first leg to allow the first leg to compress or expand along the first adjustment screw. Similarly, the second adjustment screw 95C of the second screw drive 85C penetrates through the second tip 70C of the second leg 50C. Also preferably, a pair of second leg slots 133C is included in the second leg to allow the second leg to compress or expand along the second adjustment screw.

The angled extension of the first leg 45C and the second leg 50C of the bottom plate 20C is also useful when a crude and rough opening 205 in a wall 210, shown in FIG. 9, or similar structure for receiving a window housed within a window jamb (not shown) or similar frame, is not exactly centered and plumb with respect to the desired final location of the window, as is typically the situation.

Figure 7:
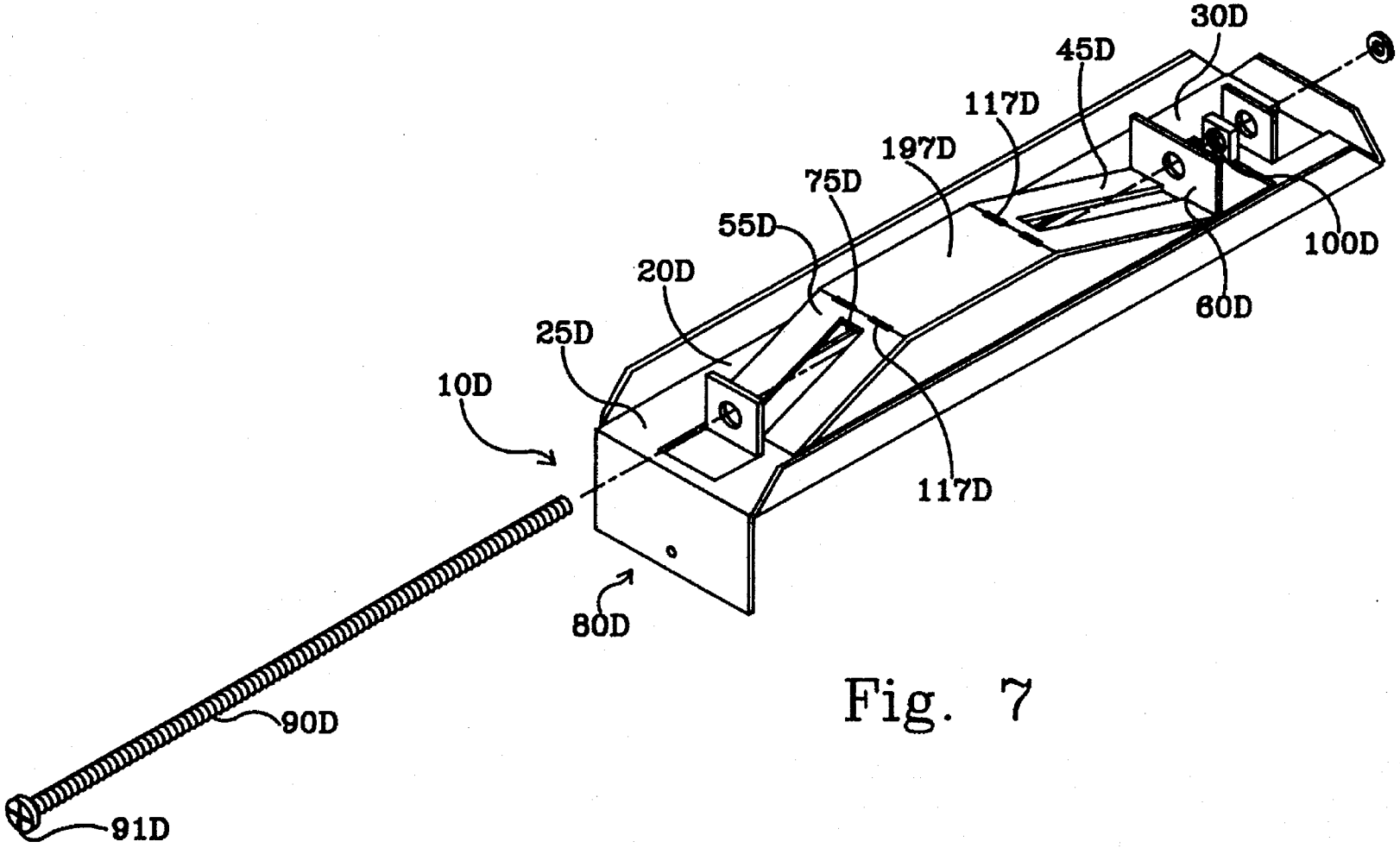
FIG. 7 is an exploded perspective diagram of a shim, according to an embodiment of this invention
Figure 8:
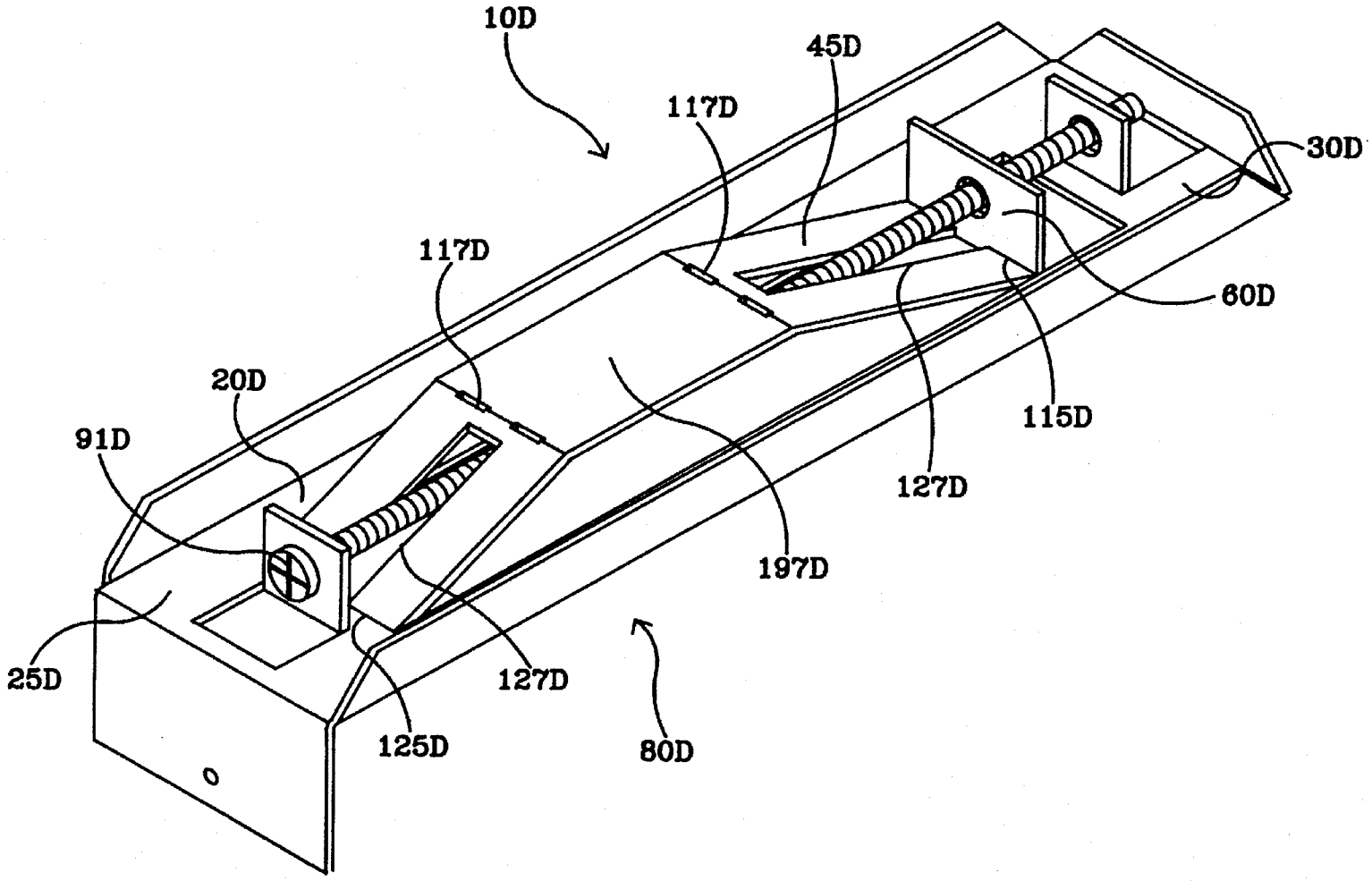
FIG. 8 is a perspective diagram of a shim, according to an embodiment of this invention.

Another alternative embodiment of the present invention is shown in FIGS. 7 and 8. The reference characters for this embodiment end in the letter "D", and the embodiment will be referred as embodiment D. Embodiment D includes a screw drive 80D attached to a bottom plate 20D. The screw drive includes an adjustment screw 901). The bottom plate is preferably rectangular in shape and has a first bottom end 25D and a second bottom end 30D. Preferably, a single leg 45D is also included in the bottom plate 10D and hingeably attached to it. The single leg has a base 55D and a tip 60D. The single leg is hingeably connected at the base to the bottom plate. The single leg has a first hinge 115D located proximate the tip, and at least a midpoint hinge 117D. Preferably, for embodiment D as shown in FIGS. 7 and 8, a pair of midpoint hinges 117D and 117D' are included in the single leg. A midleg surface 197D is formed between the midpoint hinges. The midleg surface abuts to the window jamb (not shown) or similar frame. The single leg also includes a base hinge 115D. The base hinge connects the base of the single leg to the bottom plate.

Alternatively, a plate (not shown) could be attached to the midleg surface 197D to provide a platform tho support the window jamb (not shown). Also alternatively, the plate could include a crease (not shown) for added structural strength.

The single leg 45D is preferably included in a single piece of stamped metal that comprises the bottom plate 20D. The single leg is preferably formed by a U-shaped cut 75D into the single piece of stamped metal that comprises the bottom plate. The single leg is compressible along the adjustment screw 90D. The single leg preferably hinges from the bottom plate at the first bottom end 15D. The single leg attaches to a screw drive 80D. The screw drive is preferably mounted upon the bottom plate 20D.

A nut 100D threads upon the adjustment screw 90D. The nut attaches to the tip 60D of the single leg 45D. The nut is preferably spot welded to the respective tip. The adjustment screw has a head 91D. Preferably, the head can receive a screwdriver (not shown) or similar device for rotating the head to actuate the screw drive 80D.

As preferred, when the adjustment screw 90D is rotated clockwise, the screw drive 80D forces the tip 60D to travel along the adjustment screw toward the first bottom end 25D of the bottom plate 20D, compressing the single leg 45D and raising the pair of midpoint hinges 117D and 117D'. When the first adjustment screw is rotated counterclockwise, the first screw drive forces the first tip to travel along the first adjustment screw away from the first bottom end of the bottom plate, expanding the single leg and lowering the first midpoint hinges of the single leg.

As preferred in embodiment D and shown in FIGS. 7 and 8, only the screw drive 80D is employed the shim 10D. The screw drive is oriented so that the head 91D of the adjustment screw 90D is located proximate to the first bottom end 25D of the bottom plate 20D. This orientation of the adjustment screw 90D allows adjustment of the shim 10D from the first bottom end 25D of the shim. This feature is desirable in applications where the installation of a door or window jamb make access to both sides of the door jamb or window frame difficult. Such a difficulty is typically encountered in installations where the siding or the building covers an end of the shim, preventing access to adjustment screws that could be located proximate to a covered end of the shim.

Embodiment D is similar to Embodiments B and C in that the shim 10D is adjustable from the first bottom end 25D of the shim. However, similar to embodiment C, embodiment D does not include a top plate as included in embodiments A and B. The raising or lowering of the first midpoint hinges 117D and 117D' correspondingly raises or lowers a window frame or jamb (not shown) abuted to the midleg surface 197D supported by the shim.

In embodiment D, as shown in FIGS. 7 and 8, the adjustment screw 90D of the screw drive 80D penetrates through the tip 60D of the single leg 45D. The adjustment screw also passes through the single leg. Preferably, a pair of leg slots 127D is included in the single leg to allow the single leg to compress or expand along the adjustment screw.

Alternatively, instead of the single leg 45D as described in Embodiment D, multiple legs are considered, but not specifically shown in an attached drawing. Multiple legs, able to expand and contract by single or multiple screw drives, or similar means, could be employed in a shim similar to those described herein. Embodiments A, B and C employ opposing pairs of legs, as described. However, larger numbers of legs, hingeably attached to a shim, are also considered. Additionally, the alternative embodiment C could also include only a single leg in similar to embodiment D, but without the midleg surface 197D.

Figure 10:
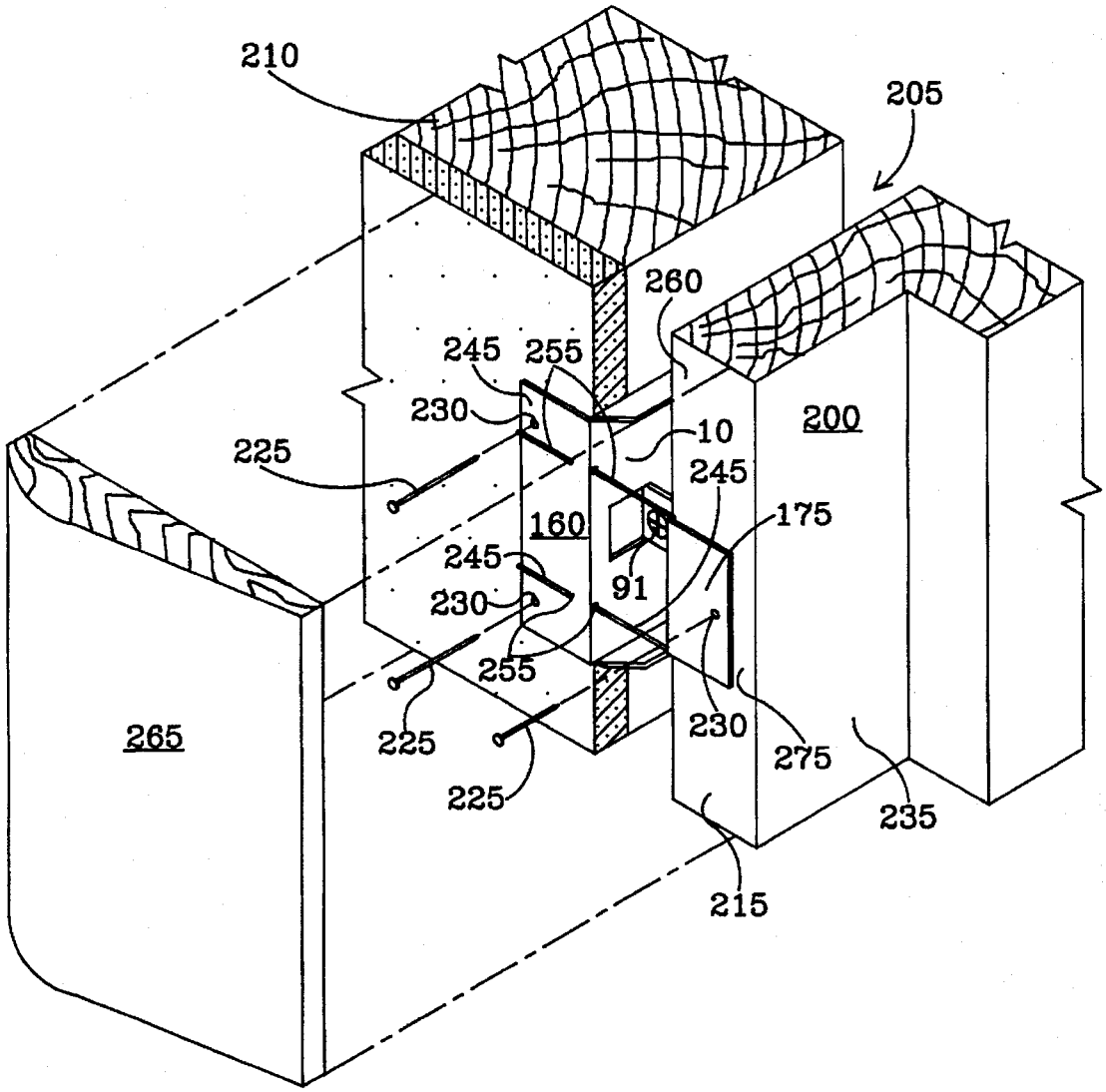
FIG. 10 is a perspective diagram of a shim installation, according to an embodiment of this invention.

FIGS. 9 and 10 show a preferred method of the invention employing embodiment A in an installation of a door jamb 200. A rough opening 205 is made in a wall 210 or structure that will receive a door (not shown) within a door jamb. To account for the thickness of the door jamb and allow for adequate space to insert the shim 10, the rough opening for the doorway should be accordingly wider and higher than the selected door size.

Before placing a door jamb 200 in the rough opening 205, shims are mounted on the door jamb. The door jamb is comprised of two vertical members, namely a hinge leg 215 and a latch leg 217, joined at their upper ends by a top member 219. The hinge leg receives the hinges of a door (not shown) and the latch leg, opposite the hinge leg receives the latch mechanism of the door.

The first top flange 175 of each shim 10 is preferably bent away from the bottom plate 20 of the shim, to form a ninety degree (90°) angle relative to the top plate 15. The shims are oriented so that the bent first top flanges are all in substantially the same horizontal plane. Alternatively, the shim in any one of the three embodiments as disclosed, can be integral to a door jamb (not shown) or window jamb (not shown), with the top plate of the shim incorporated into the window frame (not shown) or the door jamb.

A plurality of shims 10 are preferably positioned in opposing locations on either side of the vertical members of the door jamb 200. For window applications, the screw drives are preferably actuated from the same side of the shim; in door hanging applications, the screw drives are preferably actuated on opposite sides of the shim. In a preferred installation of the door jamb 200, eight to ten shims 10 are employed to align the door jamb in the wall.

In a preferred alternative installation of the door jamb 200, six shims 10 are used as shown in FIG. 9. Three shims are each spaced along the hinge leg 215 and the latch leg 217 of the doorjamb. As detailed in FIG. 10, the top plate 15 of each shim is attached to the door jamb by driving small nails 225 into the first top flange 175 and the second top flange 180 of the shim. Preferably, the nail set holes 230 are provided in the shims to aid in nailing as shown in FIGS. 1 through 10. As an alternative to nails, screws, staples or brads could be employed.

Alternatively, the first top flange 175 and the second top flange 180 can both include a set flange (not shown). The set flange would be included in the first top flange and the second top flange, and bend toward the door jamb and engage the door jamb without the need to drive a nail through a nail set hole 230 shown in FIG. 2. Also alternatively, an adhesive or glue (not shown) could be applied to the top plate 15 to adhere the top plate to the door jamb 200.

The door jamb 200 also includes a first face 260 and a second face 270 that respectively abut to the first top flange 175 and the second top flange 180 of the shim 10. One of the shims 10 is preferably attached near each of the upper sides of the door jamb on the hinge leg 215 and the latch leg 217. One of the shims is attached near each of the lower sides of the door jamb 200 on the hinge leg 215 and the latch leg 217. One of the shims is also attached near each of the midpoints of the hinge leg and the latch leg, between the upper shims and the lower shims. A total of six shims are now installed, three shims on the hinge leg and three shims on the latch leg.

Alternatively, and most preferably, two shims 10, rather than only one shim, are attached near each of the midpoints of the hinge leg 215 and the latch leg 217 of the door jamb 200, to comprise a total of four shims on each side of the door jamb. The two shims attached near the midpoints of the hinge leg and the latch leg are preferably positioned at evenly spaced intervals. Also alternatively, to achieve greater adjustability and to accommodate heavier door jambs, an installation employing ten or more shims are also considered.

The door jamb is next positioned in the rough opening 205 of the wall 210. Secure the first bottom ends of the shims 10 to the wall by nailing the first bottom flange 160 of each shim to the first face 260 of the door jamb 200. Then bend the second bottom flange 170 onto the second face 270 of the door jamb for each shim. Check the hinge leg 215 and the latch leg 217 of the door jamb with a straight edge to detect for possible bow in the door jamb. Adjust the first screw drive 80 and the second screw drive 85 of the middle shims as needed to eliminate possible bow in the door jamb.

Adjust the shims 10 by inserting a screwdriver (not shown) into the first head 91 of the first adjustment screw 90 and respectively into the second head 96 of the second adjustment screw 95, and turning the first adjustment screw and the second adjustment screw clockwise approximately four full, 360 degree turns. The adjustment screws can be turned in equal increments until the door jamb is aligned in the rough opening 205. The adjustment screws are preferably turned in equal amounts so the shims stay in line with the door jamb. Repeat this step on each of the shims until the door jamb is securely wedged in place.

After the door jamb 200 is centered in the rough opening 205, use a long level or a straight edge and a smaller level to plumb down the hinge leg 215 of the door jamb. If the hinge leg is not plumb, sequentially adjust each of the shims 10 by either retracting or extending the shims until the hinge leg is plumb. Measure the distance between the hinge leg and latch leg 217 at the bottom of the door jamb, to ensure the door width plus approximately an eighth of an inch (⅛") clearance is present. If not, reposition the shims on the door jamb so that the proper width is obtained.

Hang the door (not shown) on the door jamb 200. Close the door and adjust each shim 10 located on the latch leg 217 of the door jamb so the distance between the edge of the door and the door jamb is consistent from top to bottom. The second bottom flange 170 on the bottom plate 20 of each shim is now bent to the same downward ninety degree position as the first bottom flange 160.

Next, attach the second bottom flanges 170 to the adjacent structure of the wall 210 of the second face 270 of the door jamb 200. Preferably, a pair of small nails 225 are driven into each of the two nail set holes 230 provided on each of the second bottom flanges. Alternatively, a single nail could be employed to attach the first bottom flange or the second bottom flange to the adjacent structure of the wall. Also alternatively, adhesives, screws, rivets and any other appropriate attachment means are considered.

Sequentially adjust each of the shim's 10 first screw drives 80 and second screw drives 85 until the distance (not shown) between the door jamb and the door is the same at the upper sides 220 and the lower sides 235 of the door jamb 200.

Preferably, a first tie wire 245 and a second tie wire 250, as shown in FIGS. 1 and 10, may be needed to stabilize each of the two bottom shims 10 during the installation. The first tie wire is threaded through first tie wire holes 255 in the first bottom end 25 of the bottom plate 20 and routed around the first top flange 175 of the top plate 15. Similarly, the second tie wire 250 is threaded through second tie wire holes 256 in the second bottom end 30 of the bottom plate and routed around the second top flange 180 of the top plate. Alternatively, plastic staps, metal struts, screws or similliar means are considered for stabilizing and locking the first end and the second end of the shim.

The shims 10 can be fine tuned by turning the first head 91 of the first adjustment screw 90 and the second head 96 of the second adjustment screw 95, to properly allow the door (not shown) to operate smoothly and be substantially parallel to the wall 210. Additionally, the first tie wire 245 and the second tie 250 wire can then lock the top plate 15 in place, for the permanent furring and framing of the door casing 265 as shown in FIG. 10.

At this point, the first adjustment screws 90 and the second adjustment screws 95 of the shims 10 positioned on the lower sides of the door jamb 200 can be turned until the hinge leg 215 and the latch leg 217 are both plumb, making sure they are perpendicular with the rough opening 205 in the wall 210.

When the door jamb is in the final desired position, the first tie wire 245 and the second tie wire 250, respectively wrapped around the first top flange 175 and the second top flange 180 of the top plate 15, can be employed to lock the shim into this final position. If the first tie wire 245 and the second tie wire 250 are used, pull the tie wires tight. Twist the wires together or alternatively bend the first tie wire or the second tie wire over the respective first bottom flange or the second bottom flange. Any excess wire can be cut off.

The first tie wire prevents the first top end 35 of the top plate from extending further away from the bottom plate 20, and the second tie wire prevents the second top end 40 of the top plate from extending further away from the bottom plate. When both the first tie wire and the second tie wire are tied off on the respective first flange or second flanges of the bottom plate, the top plate is immobilized and locked in place. Again, alternatively, plastic staps, metal struts, screws or similliar means are considered for immobilizing and locking the first end and the second end of the shim.

Alternatively, if an embodiment of the present invention is employed that does not include the top plate 15 a discribed in embodiment C, the fist leg 45C and the second leg 50C or the single leg 45D as described in embodiment D abut the frame (not shown). Also alternatively, when a single leg is employed as described in embodiment D, the screw drive 80D is adjusted to angularly engage the frame in cooperation with adjacent shims 10D

Finally, a casing 265 can be prepared and installed to cover the edge of the rough opening 205 in the wall, extending to the reveal 275. Preferably, the first top flange 175 and the second top flange 180 are employed as guides for the reveal as shown in FIG. 10. Door hardware (not shown), including a latch set and a door knob, may now be added to complete the installation.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims that follow.

What is claimed is:

1. An extendible and tiltable shim wherein the shim comprises a top plate and a bottom plate, the top plate having a hingeably connected opposing pair of legs that are extendable from the top plate, the opposing pair of legs of the top plate attached to an extension means, the extension means mounted upon the bottom plate, the extension means for adjusting the height and the angle of the top plate relative to the bottom plate by extending the opposing pair of legs.

2. The extendible and tiltable shim of claim 1 wherein the extension means is a rotatable screw drive.

3. The extendible an tiltable shim of claim 1 wherein the bottom plate is adapted to be mounted to a structure member and the top plate is adapted to be mounted to a frame member.

4. The extendible and tiltable shim of claim 3 wherein the frame member is a door frame member.

5. The extendible and tiltable shim of claim 3 wherein the frame member is a window frame member.

6. An extendible and tiltable shim wherein the shim comprises a bottom plate, the bottom plate having at least a single leg, the single leg hingeably connected to the bottom plate, the single leg extendable from the bottom plate, the single leg of the bottom plate attached to an extension means, the single leg includes an extendable midpoint hinge, the extension means mounted upon the bottom plate, the extension means for adjusting the height of the midpoint hinge relative to the bottom plate by extending the single leg.

7. The extendible and tiltable shim of claim 6 wherein the extension means is a rotatable screw drive.

8. The extendible and tiltable shim of claim 6 wherein the bottom plate is adapted to be mounted to a frame member.

9. The extendible and tiltable shim of claim 8 wherein the frame member is a window frame member.

10. The extendible and tiltable shim of claim 8 wherein the frame member is a door frame member.

11. The extendible and tiltable shim of claim 6 wherein the at least a single leg is a multiple of legs.

12. The extendible and tiltable shim of claim 6 wherein the at least a single leg is a multiple of legs, the multiple of legs each hingeably connected to the bottom plate, the multiple of legs each extendable from the bottom plate, the multiple of legs of the bottom plate each attached to an extension means, the multiple of legs each includes at an extendable midpoint hinge, the extension means for adjusting the height of the midpoint hinges relative to the bottom plate by extending the multiple of legs.

13. A method of installing an extendible and tiltable shim comprising the steps of:

a) providing a shim that includes a bottom plate, a top plate and a hingeably connected opposing pair of legs, the opposing pair of legs being extendable from the bottom plate;

b) attaching a top plate of the shim to a frame;

c) extending the opposing pair of legs to contact the bottom plate to a structure; and d) adjusting the extension of the opposing pair of legs to center and plumb the frame.

14. The method of claim 13 additionally comprising the steps of:

a) immobilizing a first end of the shim; and b) immobilizing a second end of the shim.

15. A method of installing an extendible and tiltable shim comprising the steps of:

a) providing a shim that includes a bottom plate and a minimum of a single leg that is hingeably to the bottom plate and extendable from the bottom plate;

b) attaching a bottom plate of the shim to a structure;

c) extending the leg to contact a frame; and d) adjusting the extension of the leg to center and plumb the frame.

* * * * *

UNITED STATES PATENT AND TRADEMARK OFFICE

CERTIFICATE OF CORRECTION

PATENT NO. : 5,655,343

DATED : August 12, 1997

INVENTOR(S) : Frederick L. Seals

It is certified that error appears in the above-identified patent and that said Letters Patent is hereby corrected as shown below:

At column 1, line 42, change "damp" to --clamp--;

At column 1, line 64, change "falls" to --fails--;

At column 2, line 10, change "damp" to --clamp--;

At column 2, line 15, change "dip" to --clip--;

Signed and Sealed this

Fourteenth Day of April, 1998

Bruce Lehman

*Attest:*

BRUCE LEHMAN

*Attesting Officer*

*Commissioner of Patents and Trademarks*